US006932050B2

(12) United States Patent
Shibano et al.

(10) Patent No.: US 6,932,050 B2
(45) Date of Patent: Aug. 23, 2005

(54) ENGINE CONTROLLER FOR A VEHICLE INCLUDING AN AUTOMATIC CENTRIFUGAL CLUTCH

(75) Inventors: Ken Shibano, Hamamatsu (JP); Eiichi Iyoda, Hamamatsu (JP)

(73) Assignee: Suzuki Motor Corporation, Shizuoka (JP)

( * ) Notice: Subject to any disclaimer, the term of this patent is extended or adjusted under 35 U.S.C. 154(b) by 0 days.

(21) Appl. No.: 10/815,960

(22) Filed: Apr. 2, 2004

(65) Prior Publication Data

US 2004/0216717 A1 Nov. 4, 2004

(30) Foreign Application Priority Data

Apr. 4, 2003 (JP) ..... P2003-101895

(51) Int. Cl.[7] ..... F02D 41/22; F02D 43/00

(52) U.S. Cl. ..... 123/333; 123/198 D; 123/335; 123/339.15

(58) Field of Search ..... 123/198 D, 198 DB, 123/198 DC, 333, 335, 339.1, 339.15

(56) References Cited

U.S. PATENT DOCUMENTS

| | | | | | |
|---|---|---|---|---|---|
| 4,598,679 | A | * | 7/1986 | Ohkumo et al. | 123/333 |
| 5,445,121 | A | * | 8/1995 | Kai | 123/198 DC |
| 5,929,533 | A | | 7/1999 | Streib | 123/339.1 |
| 2002/0020390 | A1 | * | 2/2002 | Sugano | 123/335 |

FOREIGN PATENT DOCUMENTS

| | | |
|---|---|---|
| JP | 64-34441 U | 3/1989 |
| JP | 9-132053 A | 5/1997 |

* cited by examiner

*Primary Examiner*—Tony M. Argenbright
(74) *Attorney, Agent, or Firm*—Nixon & Vanderhye, PCC.

(57) ABSTRACT

An engine controller for a vehicle having an automatic centrifugal clutch device, includes an engine halt controlling means (ECM) for performing engine halt control. The engine halt controlling means halts the engine with the condition that the engine speed becomes equal to or higher than a first set rotational frequency, which is set to be equal to or lower than the clutch engagement rotational frequency of the automatic centrifugal clutch device.

5 Claims, 6 Drawing Sheets

ENGINE CONTROLLER FOR A VEHICLE INCLUDING AN AUTOMATIC CENTRIFUGAL CLUTCH

BACKGROUND OF THE INVENTION (1) Field of the Invention

The present invention relates to an engine controller for a vehicle equipped with an automatic centrifugal clutch, such as a snowmobile, ATV (all-terrain vehicle), motorcycle, etc., including an idle speed control (abbreviated hereinbelow as ISC) device disposed in the engine intake system for adjusting the amount of intake air by a throttle valve.

(2) Description of the Prior Art

Concerning engine intake systems for regulating the amount of intake air based on control of the opening degree at the throttle valve of an engine mounted on vehicles, such as snowmobiles, having an automatic centrifugal clutch, there are those that adopt ISC devices for controlling the idle speed by adjusting the amount of bypass air.

In a vehicle including such an ISC device, an ECM (electronic control module) is provided for the ISC device, so as to control the amount of intake air at the time of the throttle valve being fully closed, for each of the following modes (as to the prior art relating to the ISC device, refer to Japanese Utility Model Application Laid-open Sho 64 No. 34441 (FIG. 1 and the full text of the specification)).

In ISC, in startup mode, control at a start of the engine is performed by adjusting the amount of bypass air to the controlled amount for start in accordance with the cooling water temperature plus corrections for altitude and other factors.

In the complete explosion mode other than the startup mode, the basic control amount is corrected in accordance with the cooling water temperature and at the same time the idle speed is controlled by regulating the amount of bypass air.

In vehicles having an automatic centrifugal clutch, e.g., snowmobiles, a typical configuration which has such a configuration that the clutch becomes engaged to transfer the driving force from the engine to the drive shaft when the engine speed reaches about 2800 rpm is adopted.

Therefore, if the engine speed exceeds the clutch engagement rotational frequency, there is a possibility of the vehicle starting to run regardless of the rider's intention.

To avoid this, in the ISC device, the amount of bypass air at startup mode is controlled by determining the controlled value of the amount of bypass air of ECM so that the engine speed will be lower than the clutch engagement rotational frequency.

However, startup of an engine with ISC at very low temperatures or use of it at a high-altitude site where air density is low needs to be considered, a configuration having a large bypass air capacity should be selected. In this case, if the ISC device breaks down and stops with its full-open side, the aforementioned controlled value is invalidated at startup, so that an excessive amount of bypass air is supplied to increase the engine speed, whereby there arises a risk that the automatic centrifugal clutch becomes engaged in error, causing the vehicle to start running.

In the above ISC device, there is a possibility that the engine speed might increase due to breakdown of ISC, not only at startup but also when the engine is retarded with the throttle cut off. This should also be prevented. That is, occurrences of malfunction are not limited to the state where the travelling speed is zero (the vehicle being stopped).

In this case, however, if fuel cutoff (or ignition cutoff) control is performed when the engine speed becomes exceeding a set engine speed (this configuration has not been published), it is possible to prevent the vehicle from starting to travel unexpectedly. However, when the vehicle is retarded by completely closing the throttle valve into its off-throttle state, fuel supply is cut off at engine speeds greater than the set engine speed no matter what speed the vehicle travels at. Particularly, excess engine brake acts on the vehicle when it is retarded from a high travelling speed, causing significant degradation of rider's sensation during traveling.

SUMMARY OF THE INVENTION

The present invention has been devised in view of the above conventional problems, it is therefore an object of the present invention to provide an engine controller of an engine unit with an idle speed control (ISC) device for use in a vehicle including an automatic centrifugal clutch, the controller capable of preventing unintentional increase in engine speed even if the ISC device breaks down and capable of preventing excessive effect of engine brake resulting from fuel cutoff or ignition cutoff hence preventing degradation of driver's sensation during traveling.

In order to achieve the above object, the present invention is configured as follows:

In accordance with the present invention, an engine controller for a vehicle using an automatic centrifugal clutch device for power transmission, is characterized in that an idle speed control means is provided for an engine intake system that adjusts the amount of intake air by implementing control of the opening degree of a throttle valve, and the engine controller comprises: a full-close state detecting means for detecting the full-close state of the throttle valve;

an engine speed detecting means for detecting the engine speed; and an engine halt controlling means for implementing engine halt control based on the halt control starting conditions that the detected engine speed is equal to or greater than a first set rotational frequency, which is set to be equal to or lower than the clutch engagement rotational frequency of the automatic centrifugal clutch device, and that the full-closed state of the throttle valve is detected.

In the present invention, it is preferred that the engine halt controlling means is adapted to start engine halt control taking a delay time from the fulfillment of the halt control starting conditions, and the delay time is set depending on the engine speed or is set to be longer when the vehicle travels at a high speed above a predetermined level or at high engine speeds, than when the vehicle travels at a low speed below a predetermined level or at low engine speeds.

In the present invention, it is preferred that the engine halt controlling means is adapted to restrain engine halt control when the engine speed is equal to or greater than a second set rotational frequency which is equal to or higher than the first set rotational frequency.

Further, in the present invention, it is preferred that the engine controller further includes: an engine restoration control means which makes control of restoring the engine operating state by stopping engine halt control, which has been performed by the engine halt controlling means based on the fulfillment of halt conditions, with the condition that the full close state of the throttle valve is released or with the condition that the engine speed becomes equal to or lower than a third set rotational frequency which is equal to or lower than the first set rotational frequency.

Finally, in the present invention, it is preferred that the engine halt controlling means implements engine halt control by cutting off fuel supply to the engine or by cutting off ignition of the engine.

DESCRIPTION OF THE PREFERRED EMBODIMENTS

The embodiment of the present invention will hereinafter be described with reference to the accompanying drawings.

Figure 1:
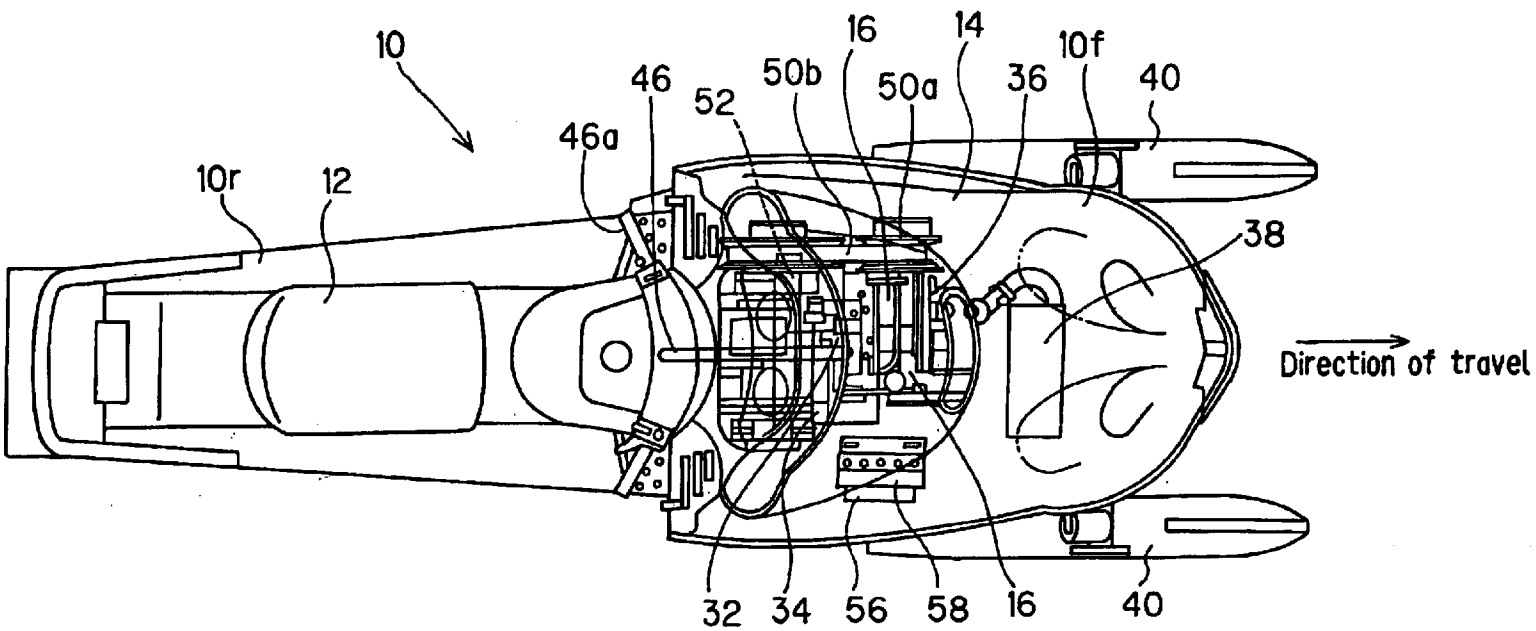
FIG. 1 is a constructional illustration showing, in plan, a snowmobile mounted with a four-cycle engine having an automatic centrifugal clutch and ISC, to which the embodiment of the present invention is applied.
Figure 2:
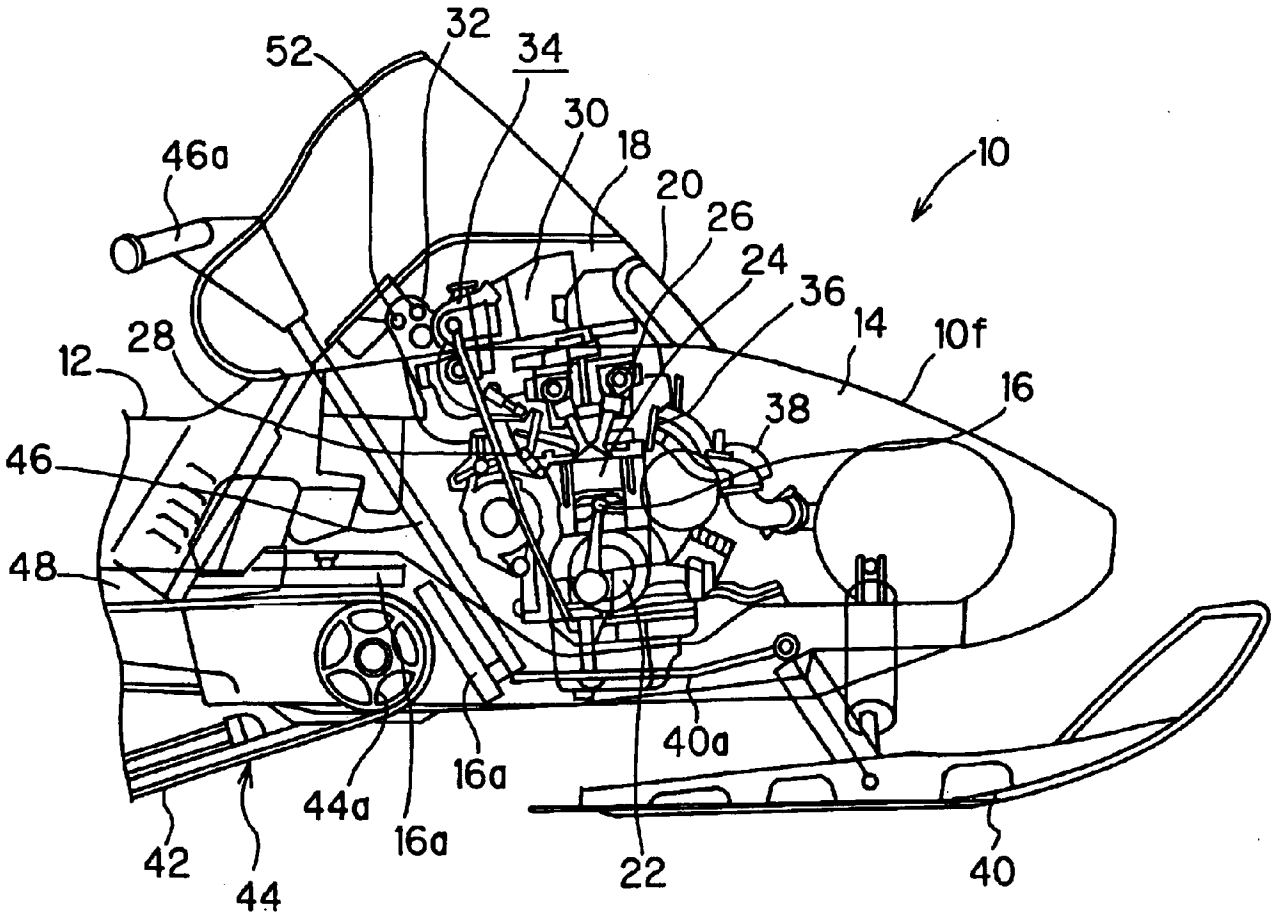
FIG. 2 is an illustrative side view showing the front part of the snowmobile.

As shown in FIG. 1 to 2, the snowmobile of the embodiment is one which includes a three-cylinder (one example of a multi-cylinder configuration) four-cycle engine 16 accommodated in an engine hood 14 located in front of a rider's seat 12, in the front body, designated at 10*f* of a vehicle body 10. The engine hood 14 has a headlight 20 formed on the front side of the topmost part thereof (in a projected portion 18 that projects upward in this embodiment). The four-cycle engine 16 is mounted in such a manner that its crankshaft 22 is arranged in the body width direction while the central axis of a cylinder block 24 is tilted rearward, forming a rearward tilted engine. An intake system 34 of engine 16 includes an air cleaner box 30 and throttle body 32 connected to intake ports 28 at the rear of a cylinder head 26 of the engine 16, and at least part of intake system 34 is accommodated in the rear space of headlight 20 inside the projected portion 18 at the top of the engine hood 14. An ISC valve 52, described later, is provided for throttle body 32 of the intake system. An exhaust system 38 is extended from exhaust ports 36 at the front of cylinder head 26 so that exhaust is led forwards to the front of cylinder block 24.

As shown in FIGS. 1 and 2, the snowmobile according to the embodiment has a pair of steerable ski-runners 40, left and right, at the bottom of front body 10*f* of vehicle body 10 which extends in the front-to-rear direction. These steerable ski-runners 40 are rotatably mounted so that they turn left and right. Arranged under the rear body, designated at 10*r*, on which the aforementioned rider's seat 12 is mounted, is a crawler 44 which circulates a track belt 42.

This crawler 44 comprises a drive wheel 44*a* arranged at the front end of rear body 10*r*, an idle wheel arranged at its rear end and a multiple number of middle wheels, a suspension mechanism for supporting and cushioning these items and track belt 42 wound around these wheels and driven circulatively.

The vehicle body 10 has a monocoque frame configuration. The front body (engine mount frame) 10*f* with four-cycle engine 16 mounted thereon is so shaped that it gradually becomes narrower as it goes forwards, in its top view, having, overall, a ship's bottom-like configuration with a top opening, which is enclosed by engine hood 14, thereby forming an engine compartment therein.

A steering shaft (also called steering post) 46 is projectively provided so as to be somewhat inclined rearwards in front of seat 12 in the rear part of engine hood 14. A pair of steering handlebars 46*a* for steering control are attached at the top end of this steering shaft 46. The bottom end of steering shaft 46 is rotatably supported at a position adjoining a crawler house portion 48 by the vehicle body and passes the steering force to a steering mechanism 40*a* for turning ski-runners 40 to the left and right for maneuvering, by means of an unillustrated linkage mechanism. A heat exchanger 16*a* for heat exchanging (cooling) the cooling water of the engine 16 is arranged in the rear part of the bottom end of steering shaft 46 and at a place opposing the front end of crawler 44 of crawler house 48.

Cylinder head 26 arranged on the top of cylinder block 24 has intake and exhaust valves for opening and shutting intake and exhaust ports 28 and 36 that are connected to the combustion chambers of cylinder block 24 and their valve gear mechanisms. In this way, the engine of this embodiment has a double-overhead cam type, water-cooled four-cycle engine configuration.

As shown in FIG. 1, the output from crankshaft 22 of the engine 16 is first transmitted to an automatic centrifugal clutch 50*a* provided on the left side with respect to the vehicle's width, then in turn to drive wheel 44*a* of the crawler by way of a belt type continuously variable transmission 50*b* and unillustrated reduction gears.

Figure 3:
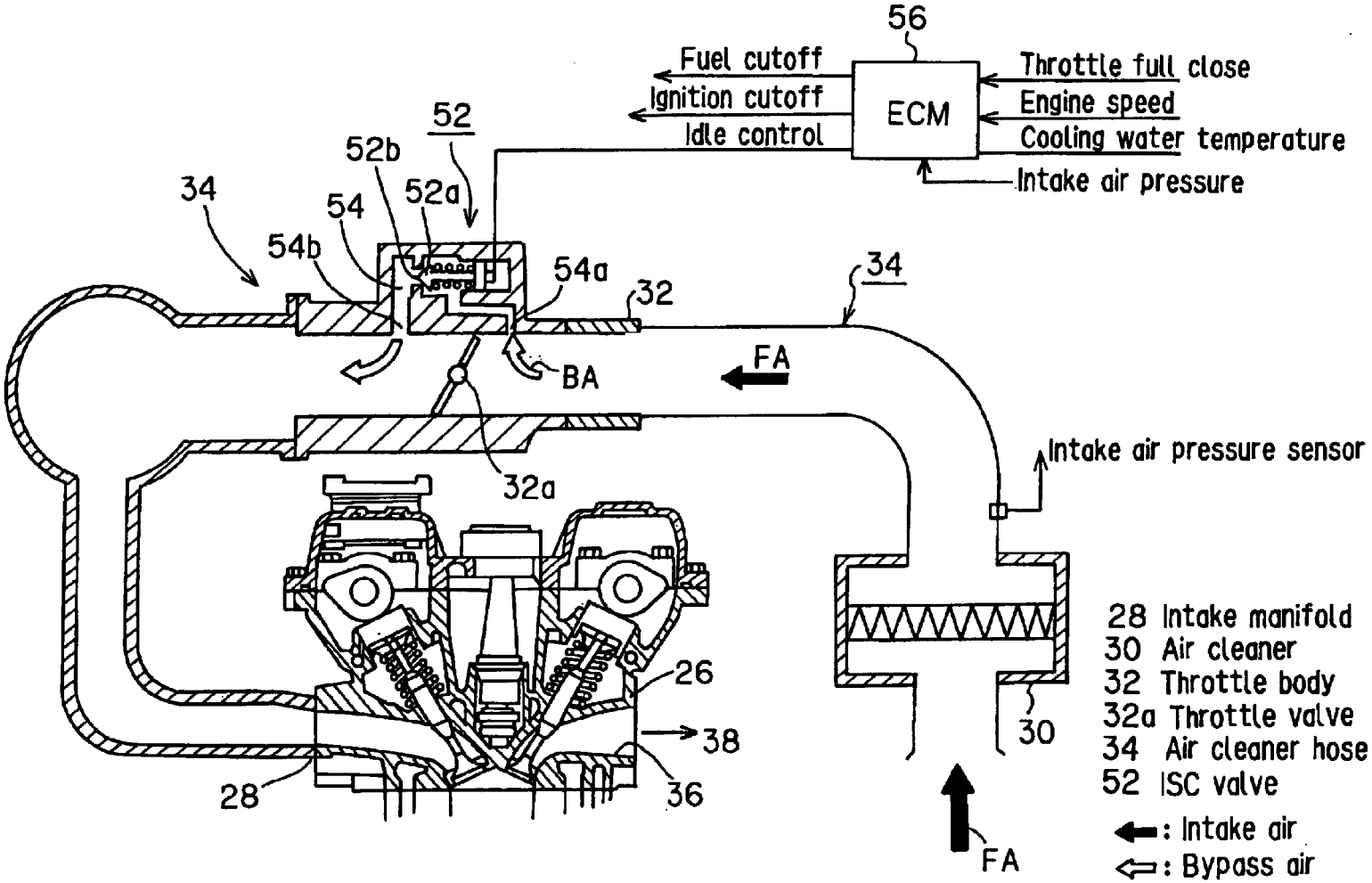
FIG. 3 is an illustrative view showing a constructional example of an ISC valve according to the embodiment.

As shown in FIG. 3, in the intake system 34 to cylinder block 24, air filtered through air cleaner 30 passes through throttle body 32 and is distributed to the intake ports (intake manifold) 28 of individual cylinders. The amount of intake air can be checked indirectly by measuring the intake air pressure with an unillustrated pressure sensor, for example.

In the intake system 34, a throttle valve 32*a* is provided in the throttle body 32 so as to change the opening degree of the passage, whereby the amount of intake air to the intake air system 34 is regulated to control engine output.

Provided for throttle body 32 is a bypass air passage 54 for allowing part of air, bypassing the throttle valve 32*a*, to be supplied for adjustment of the idle speed. ISC valve 52 for controlling the amount of bypass air is provided in bypass air passage 54 (this bypass passage 54 for intake air may be provided either integrally with, or separately from, the throttle body).

In FIG. 3, intake air is indicated by FA (black arrow) and bypass air is indicated by BA (outline arrow).

In bypass air passage 54, an air input side 54*a* is located upstream of throttle valve 32*a* and an air output side 54*b* is located downstream thereof. The ISC valve 52 arranged on the way is constructed such that a valve pintle 52*a* is driven in and out by an actuator (e.g., stepper motor actuator) to control the opening degree of a hole 52*b* that forms part of the bypass air passage.

In this ISC valve 52, an electronic control module (ECM) 56, using the intake air pressure as one of detection data, outputs a control signal, based on which the amount of bypass air or the opening of ISC valve 52 is controlled so as to stabilize the idle speed.

Specifically, ECM 56 is adapted to receive a throttle full-close signal (idling switch-on-signal), an engine speed signal, a cooling water temperature signal and an intake pressure signal and output an idle speed control signal to ISC valve 52 as well as outputting a fuel cutoff signal and an ignition cutoff signal.

In accordance with the output control signal from ECM 56, ISC valve 52 supplies a necessary amount of bypass air for idling to intake ports 28 when the throttle valve 32*a* is in its full-close state. Further, ISC valve 52 controls the idle speed by supplying a drive signal to the actuator based on the control of ECM 56. When the cooling water temperature is low, the engine idle is adapted to increase by opening bypass passage 54 by means of ISC valve 52. In this case, ECM 56 is arranged on the side face of a battery 58 inside the engine compartment of the snowmobile, as shown in FIG. 1.

Next, description will be made of the engine halt control during idling effected by ECM 56, in accordance with the embodiment, in the snowmobile equipped with the thus configured ISC valve 52. This ECM 56 control can be performed by either programmed software or hardware.

Figure 4:
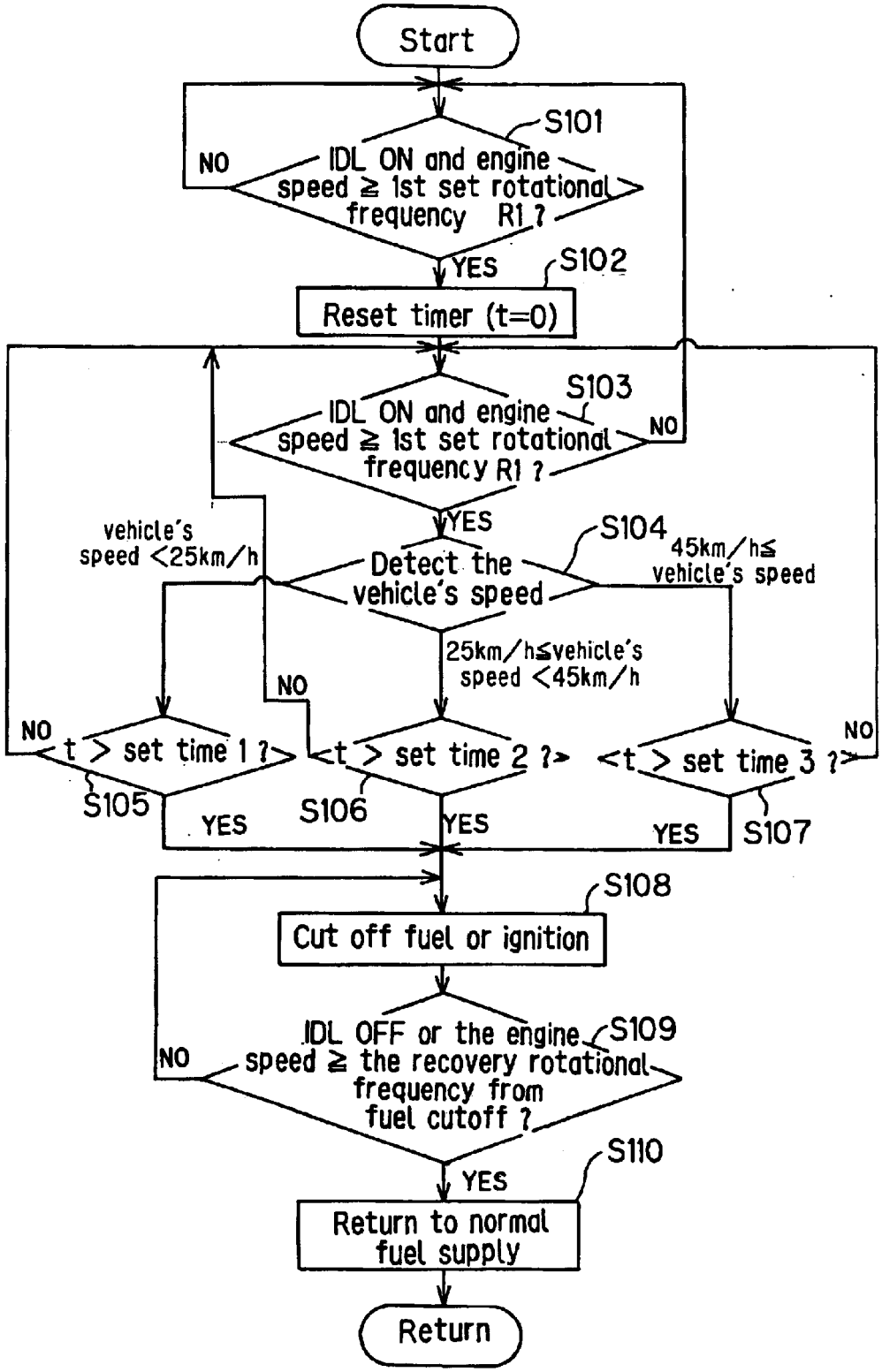
FIG. 4 is a flowchart showing the engine halt control according to the first embodiment.
Figure 5:
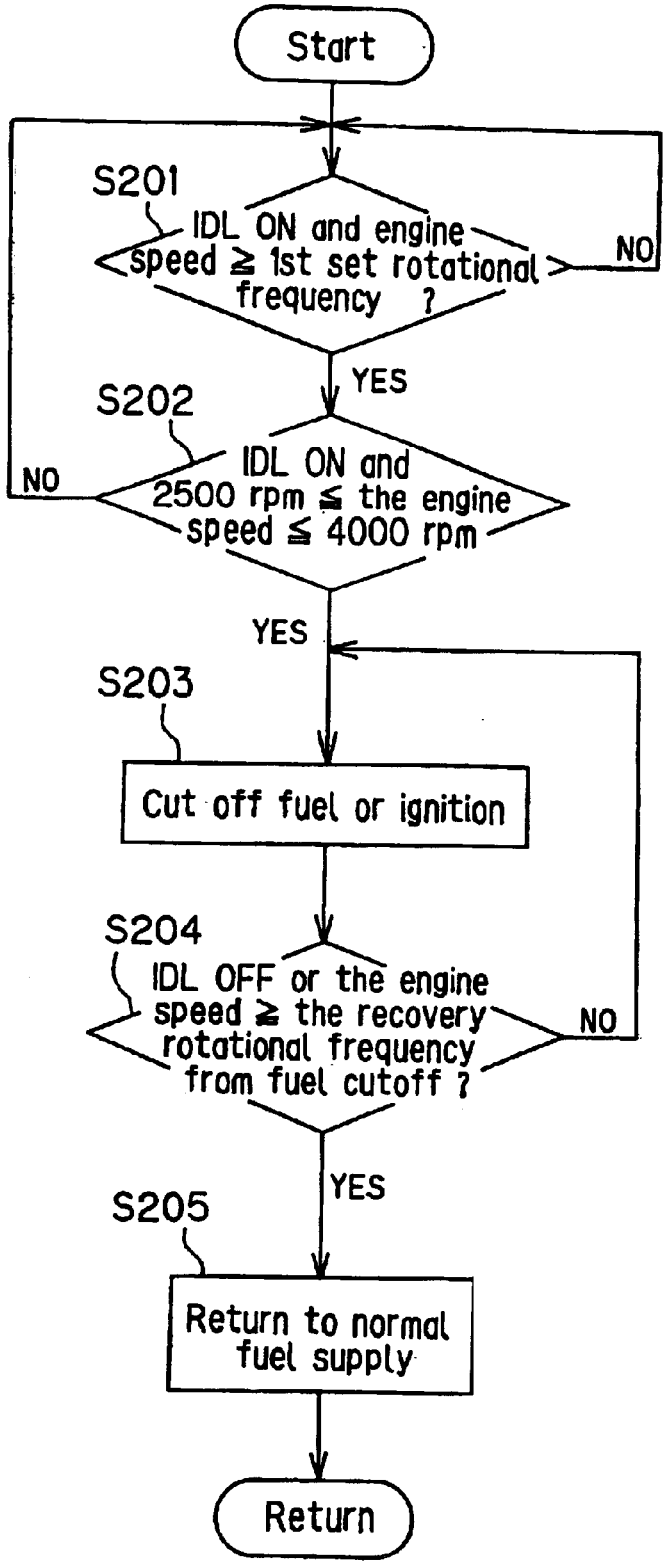
FIG. 5 is a flowchart showing the engine halt control according to the second embodiment.

FIG. 4 is a flowchart showing an engine halt control in accordance with the first embodiment. When predetermined conditions are fulfilled, fuel cutoff or ignition cutoff is effected to stop the engine. In FIGS. 4 and 5 and the following description, abbreviations are used like Step 101 being written as S101.

In the flow shown in FIG. 4, first, the operation is waited ready until throttle valve 32*a* becomes fully closed so the idle switch turns on (ON) and the engine speed becomes equal to or greater than a first set rotational frequency R1 (S101). This first set rotational frequency R1 is determined within a range of 2500 to 2800 rpm, for example, which is not higher than the clutch engagement speed (e.g. 2800 rpm) of automatic centrifugal clutch device 50*a*. Based on this first set rotational frequency (R1), the engine halt control initiating conditions include the condition that the engine speed becomes equal to or greater than the first set rotational frequency. Further, the first set rotational frequency can be changed in accordance with the engine operating conditions such as cooling water temperature.

When the condition at S101 is satisfied, a timer t is reset (S102) in order to measure the delay time described later. Subsequently, it is again judged whether throttle valve 32*a* becomes fully closed and the idle switch is turned on (ON), and whether the engine speed is equal to or greater than the first set rotational frequency R1 (S103).

If the condition at S103 is satisfied, the speed of the vehicle is detected: if the detected vehicle's speed is lower than 25 km/h (vehicle's speed<25 km/h), then the operation goes to S105; if it is equal to or greater than 25 km/h and lower than 45 km/h (25 km/h≦vehicle's speed<45 km/h), then the operation goes to S106; and if it is equal to or greater than 45 km/h (45 km/h≦vehicle's speed), then the operation goes to S107 (S104).

At S105, the operation is waited by repeating the loop of S103, S104 and S105 until a delay time t1 (0 to 30 millisecond (ms), for example) lapses.

At S106, the operation is waited by repeating the loop of S103, S104 and S106 until a delay time t2 (1200 millisecond (ms), for example) lapses.

At S107, the operation is waited by repeating the loop of S103, S104 and S107 until a delay time t3 (2500 millisecond (ms), for example) lapses.

When the delay time at S105 to S107 has lapsed, fuel supply is cut off or ignition is cut off so as to effect an engine halting process (S108). In other words, if, with the idle switch on, the engine speed is equal to or greater than the first set rotational frequency, engine halt control is implemented after a lapse of delay time t1, t2 or t3, depending on the engine speed, instead of immediately starting an engine halt process by fuel cutoff or by ignition cutoff.

Thereafter, when the throttle is opened by accelerator control so the idle switch turns off (OFF) or when the engine speed is equal to or lower than a recovery rotational frequency (R3: the third set rotational frequency) (YES at S109), the engine halt control by fuel cutoff or by ignition cutoff is stopped: a recovery process for returning to the normal operating state is implemented by restarting fuel supply or ignition so that the engine can be accelerated or can be kept idling (S110). Because the engine would cause hunting between its inactive and active states, generating strong vibration if the engine is stopped and restarted immediately after the engine speed becomes lower than the first set rotational frequency, the recovery process is adapted to be implemented by setting up a low recovery rotational frequency a certain amount apart from the first set rotational frequency so as to avoid such generation of hunting.

In the first embodiment, the engine 16 is stopped under the conditions involving the condition that the engine speed of engine 16 becomes equal to or greater than the first set rotational frequency, based on the first set rotational frequency, which is set to be equal to or lower than the clutch engagement rotational frequency of the automatic centrifugal clutch device 50*a*. Therefore, even if, at a startup or during retardation with the throttle off, ISC valve 52 breaks down and stops in its full-open state, the engine speed can be prevented from increasing by implementing engine halt control. As a result, automatic centrifugal clutch device 50*a* is avoided from becoming engaged, thus making it possible to prevent the vehicle from starting to run contrary to the rider's intention.

Further, in order to actuate fuel cutoff or ignition cutoff with the condition that the engine speed is equal to or greater than the first set rotational frequency, three classes of delay time t1 to t3 are prepared depending on the vehicle's speed (or the engine speed), and fuel cutoff or ignition cutoff is effected waiting the lapse of delay time after the engine halt conditions are fulfilled. For this purpose, no or short delay time is given when the vehicle travels at low speeds whereas a longer delay time is given at high speeds of travel. That is, at a startup or during idling, no or short delay time is selected so as to efficiently prevent the vehicle from starting to travel contrary to the rider's intention while at a high speed travel, a long delay time is selected so as to alleviate sudden effect of engine braking.

FIG. 5 is a flowchart showing the engine halt control according to the second embodiment. In this second embodiment, when predetermined conditions are fulfilled, fuel cutoff or ignition cutoff is effected to stop the engine. However, no engine stop is performed when the engine speed is in excess of a second set rotational frequency (R2).

In the flow of FIG. 5, first, the operation is waited ready until throttle valve 32*a* becomes fully closed so the idle switch turns on (ON) and the engine speed becomes equal to or greater than a first set rotational frequency (S201).

When the condition at S201 is satisfied, it is judged whether the idle switch turns on (ON) and whether the engine speed is equal to or greater than 2500 rpm and equal to or lower than a second set rotational frequency (S202). This second set rotational frequency may be set at 4000 rpm, for example.

When the judgement at S202 results in YES, engine halt control is implemented by fuel cutoff or ignition cutoff (S203).

Thereafter, when the throttle is opened by accelerator control so the idle switch turns off (OFF) or when the engine speed is equal to or lower than a recovery rotational frequency (YES at S204), the engine halt control by fuel cutoff or by ignition cutoff is stopped, and a recovery process for returning to the normal operating state is implemented by restarting fuel supply or ignition so that the engine can be accelerated or can be kept idling (S205).

In the second embodiment, when the engine speed increases equal to or higher than the first set rotational frequency, fuel cutoff or ignition cutoff is effected so as to avoid the vehicle unintentionally starting to run at startup or during off-throttle, due to breakdown of the ISC valve. In addition, when the engine speed is equal to or higher than the second set rotational frequency, engine halt control by fuel cutoff or ignition cutoff will not be implemented, so that excessive effect of engine braking at speeds above the middle rotational frequency range (e.g., 4000 rpm or greater, for example) to the high range will not occur, whereby it is possible to improve rider's riding sensation as well.

Figure 6:
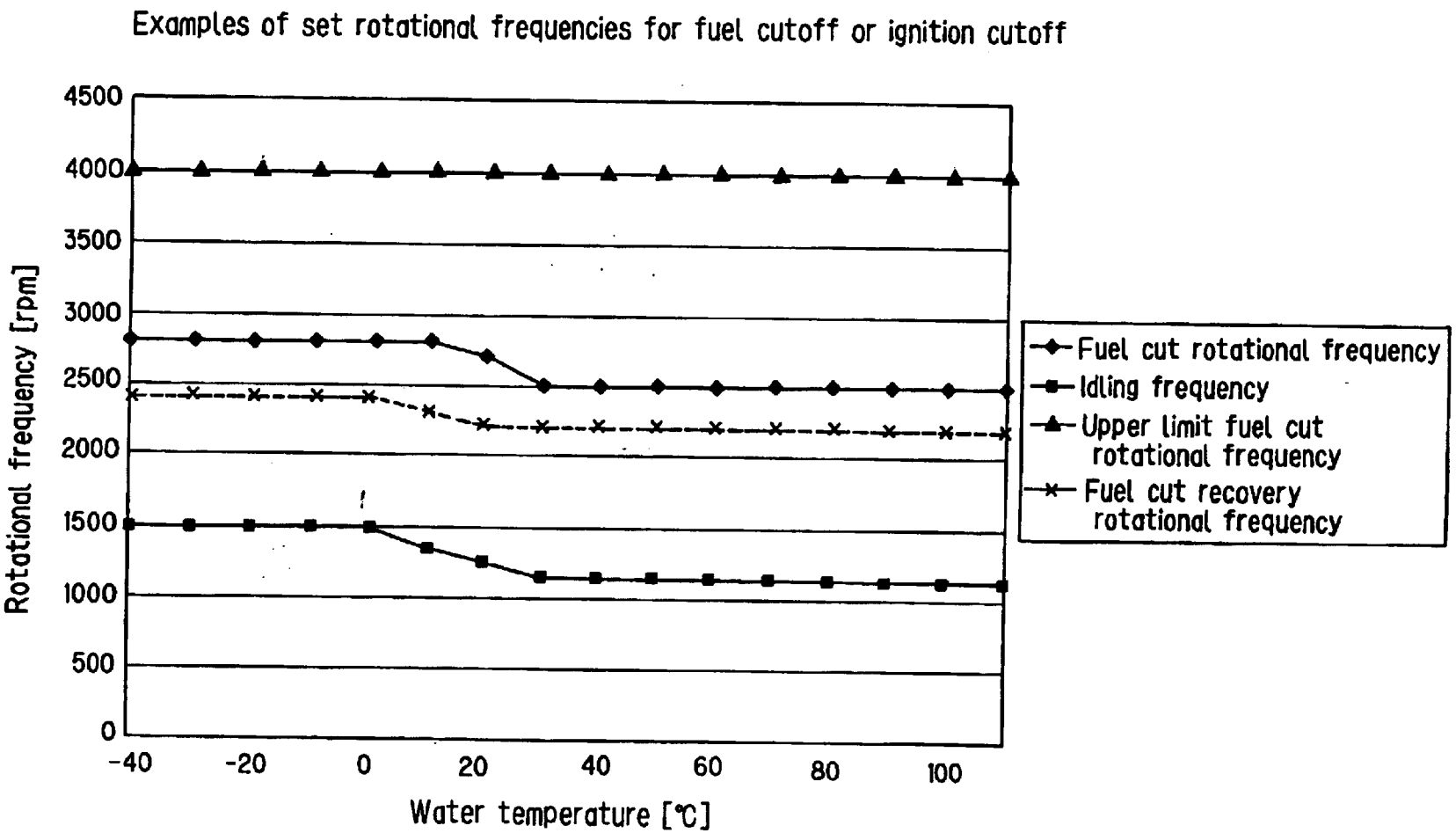
FIG. 6 is an illustrative view showing examples of set rotational frequencies for fuel cutoff or ignition cutoff.

FIG. 6 shows one example of fuel cut rotational frequency as the first set rotational frequency for fuel cutoff or ignition cutoff, the upper limit of the fuel cut rotational frequency as the second set rotational frequency, and one example of fuel cut recovery rotational frequency. These set values are mere examples, however can be used for other embodiments of the present invention than the first and second embodiments. The first set rotational frequency, the second set rotational frequency, the recovery rotational frequency and the idle speed are set higher in the temperature range where the temperature of the cooling water is 0 deg. C. or below so as to assure startup performance in cold districts.

The scope of the present invention should not be limited to the vehicles such as snowmobiles using the aforementioned ISC valve, but the invention can be applied to vehicles having an automatic centrifugal clutch with an idle speed control means. The set rotational frequencies, selected in the description of the embodiments are mere examples and can be appropriately selected in accordance with the engine characteristics and the engagement rotational frequency of the startup clutch device.

Further, for engine halt control, ignition cutoff or fuel cutoff is implemented, but these may be performed in parallel or separately. It is also possible to adopt other engine halting means if any.

As has been described, according to the present invention, the engine is halted under the conditions involving the condition that the engine speed becomes equal to or greater than a first set rotational frequency, based on the first set rotational frequency, which is set to be equal to or lower than the clutch engagement rotational frequency of the automatic centrifugal clutch device. Therefore, even if, at a startup or during retardation with the throttle off, the ISC valve breaks down and stops in its full-open state, the engine speed can be prevented from increasing by implementing engine halt control, for example, by fuel cutoff or ignition cutoff for the engine. As a result, the automatic centrifugal clutch device is avoided from becoming engaged, thus making it possible to prevent the vehicle from starting to run contrary to the rider's intention.

Further, in order to actuate fuel cutoff or ignition cutoff with the condition that the engine speed is equal to or greater than the first set rotational frequency, different delay times are prepared depending on the vehicle's speed (or the engine speed), and fuel cutoff or ignition cutoff is effected waiting the lapse of delay time after the engine halt conditions are fulfilled. For this purpose, it is preferred that no or short delay time is given when the vehicle travels at low speeds whereas a longer delay time is given at high speeds of travel. With this settings, at a startup or during idling, no or short delay time is selected so as to efficiently prevent the vehicle from running contrary to the rider's intention while at a high speed travel, a long delay time is selected so as to alleviate sudden effect of engine braking.

Further, when the engine speed increases equal to or higher than the first set rotational frequency, fuel cutoff or ignition cutoff is effected so as to avoid the vehicle unintentionally starting to run at startup or during off-throttle, due to breakdown of the ISC valve. In addition, when the engine speed is equal to or higher than the second set rotational frequency that is equal to or higher than the first set rotational frequency, engine halt control by fuel cutoff or ignition cutoff will not be implemented, so that excessive effect of engine braking at speeds above the middle rotational frequency range (e.g., 4000 rpm or greater, for example) to the high range will not take place, whereby it is possible to improve rider's riding sensation as well.

Moreover, after engine halt control has been performed based on fulfillment of the halt conditions, with the condition that the full close state of the throttle valve is released, or with the condition that the engine speed becomes equal to or lower than a third set rotational frequency which is equal to or lower than the first set rotational frequency, the engine halt control may be stopped so as to restore the engine to the normal running mode. In this case, the engine will not be started up immediately after the engine halt process, or as soon as the engine speed lowers the first set rotational frequency, no hunting between its inactive and active states, hence no vibration will occur, so that it is possible to improve rider's riding sensation.

What is claimed is:

1. An engine controller for a vehicle using an automatic centrifugal clutch device for power transmission, wherein an idle speed control means is provided for an engine intake system that adjusts the amount of intake air by implementing control of the opening degree of a throttle valve, the engine controller comprising:

a full-close state detecting means for detecting the full-close state of the throttle valve;

an engine speed detecting means for detecting the engine speed; and an engine halt controlling means for implementing engine halt control based on the halt control starting conditions that the detected engine speed is equal to or greater than a first set rotational frequency, which is set to be equal to or lower than the clutch engagement rotational frequency of the automatic centrifugal clutch device, and that the full-closed state of the throttle valve is detected.

2. The engine controller for a vehicle having an automatic centrifugal clutch according to claim 1, wherein the engine halt controlling means is adapted to start engine halt control taking a delay time from the fulfillment of the halt conditions, and the delay time is set depending on the engine speed or is set to be longer when the vehicle travels at a high speed above a predetermined level or at high engine speeds, than when the vehicle travels at a low speed below a predetermined level or at low engine speeds.

3. The engine controller for a vehicle having an automatic centrifugal clutch according to claim 1, wherein the engine halt controlling means is adapted to restrain engine halt control when the engine speed is equal to or greater than a second set rotational frequency which is equal to or higher than the first set rotational frequency.

4. The engine controller for a vehicle having an automatic centrifugal clutch according to claim 1, further comprising:

an engine restoration control means which makes control of restoring the engine operating state by stopping engine halt control, which has been performed by the engine halt controlling means based on the fulfillment of halt conditions, with the condition that the full close state of the throttle valve is released or with the condition that the engine speed becomes equal to or lower than a third set rotational frequency which is equal to or lower than the first set rotational frequency.

5. The engine controller for a vehicle having an automatic centrifugal clutch according to claim 1, wherein the engine halt controlling means implements engine halt control by cutting off fuel supply to the engine or by cutting off ignition of the engine.

* * * * *